US005980009A

United States Patent [19]

Atalla et al.

[11] Patent Number: 5,980,009

[45] Date of Patent: Nov. 9, 1999

[54] BASKET MOUNTING ARRANGEMENT FOR A REFRIGERATOR

[75] Inventors: Samir Atalla, Oakville; Edward George Simmons, Hamilton, both of Canada

[73] Assignee: Camco Inc., Mississauga, Canada

[21] Appl. No.: 09/052,120

[22] Filed: Mar. 31, 1998

[30] Foreign Application Priority Data

Jan. 19, 1998 [CA] Canada ..... 2227355

[51] Int. Cl.[6] ..... A47B 96/06

[52] U.S. Cl. ..... 312/408; 312/301; 312/334.23

[58] Field of Search ..... 312/408, 334.23, 312/334.27, 334.7, 404, 298, 301

[56] References Cited

U.S. PATENT DOCUMENTS

| | | | |
|---|---|---|---|
| 2,065,391 | 12/1936 | Nance | 312/408 X |
| 2,089,359 | 8/1937 | Goulooze | 312/334.23 X |
| 2,103,885 | 12/1937 | Whalen | 312/408 X |
| 2,207,115 | 7/1940 | Carr | 312/408 X |
| 2,231,817 | 2/1941 | Quimper | 312/408 X |
| 2,297,859 | 10/1942 | Anderson | 312/334.23 X |
| 2,745,707 | 5/1956 | Sebens | 312/301 X |
| 3,212,835 | 10/1965 | Beckett et al. | 312/301 X |
| 3,556,625 | 1/1971 | Kauffman | 312/301 |
| 3,877,767 | 4/1975 | Bright . | |
| 4,138,175 | 2/1979 | Tattershall . | |
| 4,528,825 | 7/1985 | Khan . | |
| 4,795,041 | 1/1989 | Remmers | 312/334.23 X |
| 4,936,641 | 6/1990 | Bussan et al. . | |
| 4,944,566 | 7/1990 | Carper . | |
| 5,299,863 | 4/1994 | Albright . | |
| 5,303,997 | 4/1994 | Kropf . | |
| 5,462,348 | 10/1995 | Ellington et al. | 312/301 |
| 5,486,046 | 1/1996 | Jernstrom et al. . | |

*Primary Examiner*—Peter M. Cuomo
*Assistant Examiner*—Hanh V. Tran

[57] ABSTRACT

A basket mounting arrangement for use in a domestic refrigerator, and in particular a bottom mount refrigerator has two baskets mounted in the freezer compartment, one above the other. The lower basket is mounted relative to the freezer compartment for movement relative thereto in and out of the open front of the freezer. The second upper basket is mounted on top of the first lower basket and is movable forward and backward of the first lower basket and also out of the open front of the freezer. The mounting of the upper basket relative to the lower basket permits a user to access a majority of the food articles in the bottom mount freezer by pulling the upper basket out of the freezer and thereby pull the lower basket from the refrigerator. The user can then push the upper basket back into the freezer to gain access to articles in the lower basket from the freezer. Upper basket support rails are mounted fixedly to the lower basket and include a trackway allowing the upper basket to slide horizontally forward and backward relative to the lower basket.

16 Claims, 7 Drawing Sheets

BASKET MOUNTING ARRANGEMENT FOR A REFRIGERATOR

FIELD OF THE INVENTION

This invention relates to a refrigerator, and in particular a bottom mount refrigerator, having a pair of baskets mounted in the lower freezer compartment one above the other and relative to each other.

BACKGROUND OF THE INVENTION

With the re-introduction of bottom mount refrigerators in the marketplace in which the fresh food compartment is located vertically above the freezer compartment, there is a clear advantage to accessing food articles in the fresh food compartment over top mount refrigerators particularly in instances in which access to the freezer compartment is of lesser importance to a user. However, what is gained in accessibility to the fresh food compartment reduces the accessibility to the freezer compartment.

The bottom mount refrigerators on the market typically include a basket in the freezer compartment. The basket is located above the bottom floor of the freezer compartment and is either supported on side trackways mounted to the side walls of the freezer compartment or runs on guide rollers on the floor of the freezer compartment. The basket is able to be pulled out through the front opening of the freezer compartment to allow the user more ready access to food articles stored in the basket. Usually, the freezer compartment includes means to support one or more ice trays and this typically results in a stationary shelf that extends laterally across the freezer compartment above the basket. Because this shelf is stationary, access and viewing of food articles placed on the stationary shelf requires a typical user to bend over otherwise articles at the rear of the shelf are hidden from view.

There is a need to improve the access to the freezer in the bottom mount refrigerator without effecting the space design requirements for the freezer.

SUMMARY OF THE INVENTION

The present invention is directed to a basket mounting arrangement for use in a domestic refrigerator, and in particular a bottom mount refrigerator, in which two baskets are mounted in the freezer compartment one above the other. The lower basket is mounted relative to the freezer compartment for movement relative thereto in and out of the open front of the freezer. The second upper basket is mounted on top of the first lower basket and is movable forward and backward of the first lower basket and also out of the open front of the freezer. Advantage is found with the present invention in that it permits a user to access a majority of the food articles in the bottom mount freezer by pulling either the upper basket or lower basket out of the freezer. Further, because the upper basket is mounted relative to the lower basket, advantage is found because a user does not have to bend over as far to pull the lower basket from the refrigerator. The user can pull the lower basket from the freezer by pulling the upper basket out until the upper basket pulls the lower basket out and then pushing the upper basket back into the freezer to gain access to the lower basket already pulled from the freezer.

In accordance with an aspect of the present invention there is provided a dual basket mounting arrangement for use in a domestic refrigerator having a cavity with a rear wall, side walls and an open front. The dual basket mounting arrangement comprises a first lower basket mounted in the refrigerator between the side walls for sliding movement through the open front of the refrigerator. The first lower basket has spaced apart horizontally extending upper support arms. A pair of upper basket support rails are fixedly mounted to respective ones of the upper support arms of said first lower basket. Each of the upper basket support rails provides a second trackway receiving groove extending horizontally above and along the upper support arms. A second upper basket extends laterally between the upper support arms of the first lower basket and has spaced apart horizontally extending lower support arms adapted to slidably engage a respective second trackway of the upper basket support rails to mount the second upper basket relative to the first lower basket for sliding horizontally movement forward and backward above and relative to the first lower basket.

Preferably the horizontally extending upper support arms of the first lower basket comprise an elongate rail having at least one stem extending perpendicular to the elongate rail and has two depending flat tab surfaces with a screw receiving aperture displaced horizontally rearward and forward of the stem. Preferably, each of the upper basket support rails includes a channel portion positioned below the second trackway thereof partially surrounding a respective one of the upper support arms. The channel has a lower wall with a notch extending parallel to the stem for receiving the stem to fixedly locate the upper basket support rail and prevent forward and rearward movement relative to the upper support arms of the first lower basket. Preferably, the lower wall of the channel further includes at least two dependent flat surface bosses with a screw receiving aperture. The flat boss surface engages in flush relation the flat tab surface and a fastener securing the flat boss with the flat tab whereby the upper basket support rail is prevented from twisting about the corresponding upper support arm of the first lower basket.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
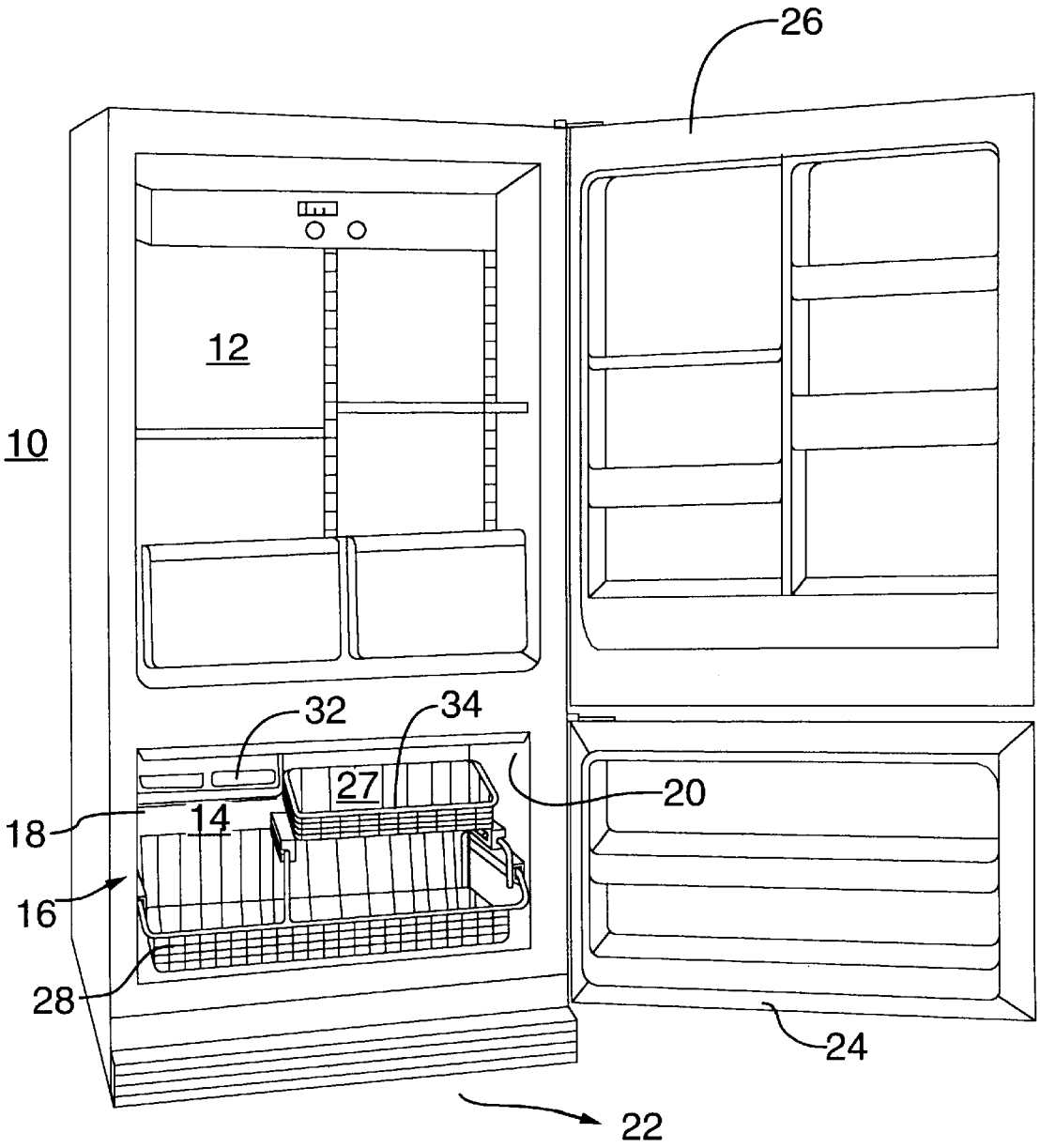
FIG. 1 is a front view of a bottom mount refrigerator having the dual basket in the freezer compartment.

In FIG. 1, a bottom mount refrigerator 10 includes an upper fresh food compartment 12, closed by door 26, and a lower freezer compartment 14. The lower freezer compartment 14 has a cavity 16 with rear wall 18, side walls 20 and an open front generally indicated by arrow 22. The open front 22 of the freezer compartment 14 is closed by door 24. Shelves, bins and trays are shown in the fresh food compartment 12 and on doors 24, 26 for storing food articles.

Figure 2:
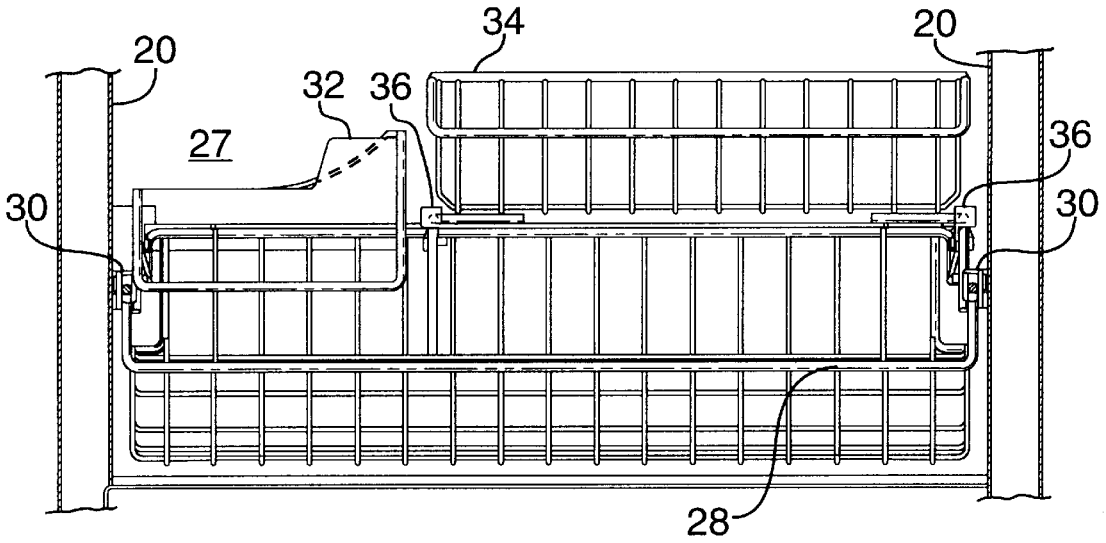
FIG. 2 is an enlarged front view of the dual basket of the present invention illustrating an alternative embodiment for the location of the ice tray.
Figure 3:
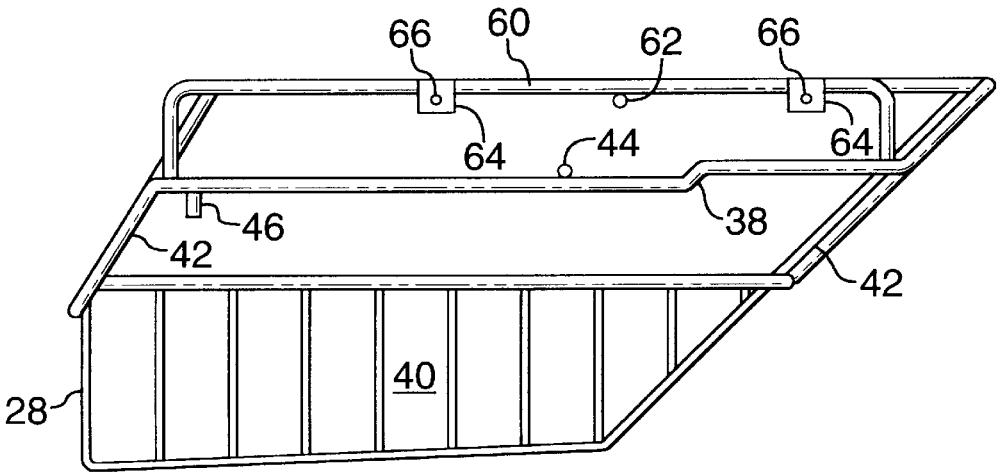
FIG. 3 is a side view of the lower basket.
Figure 4:
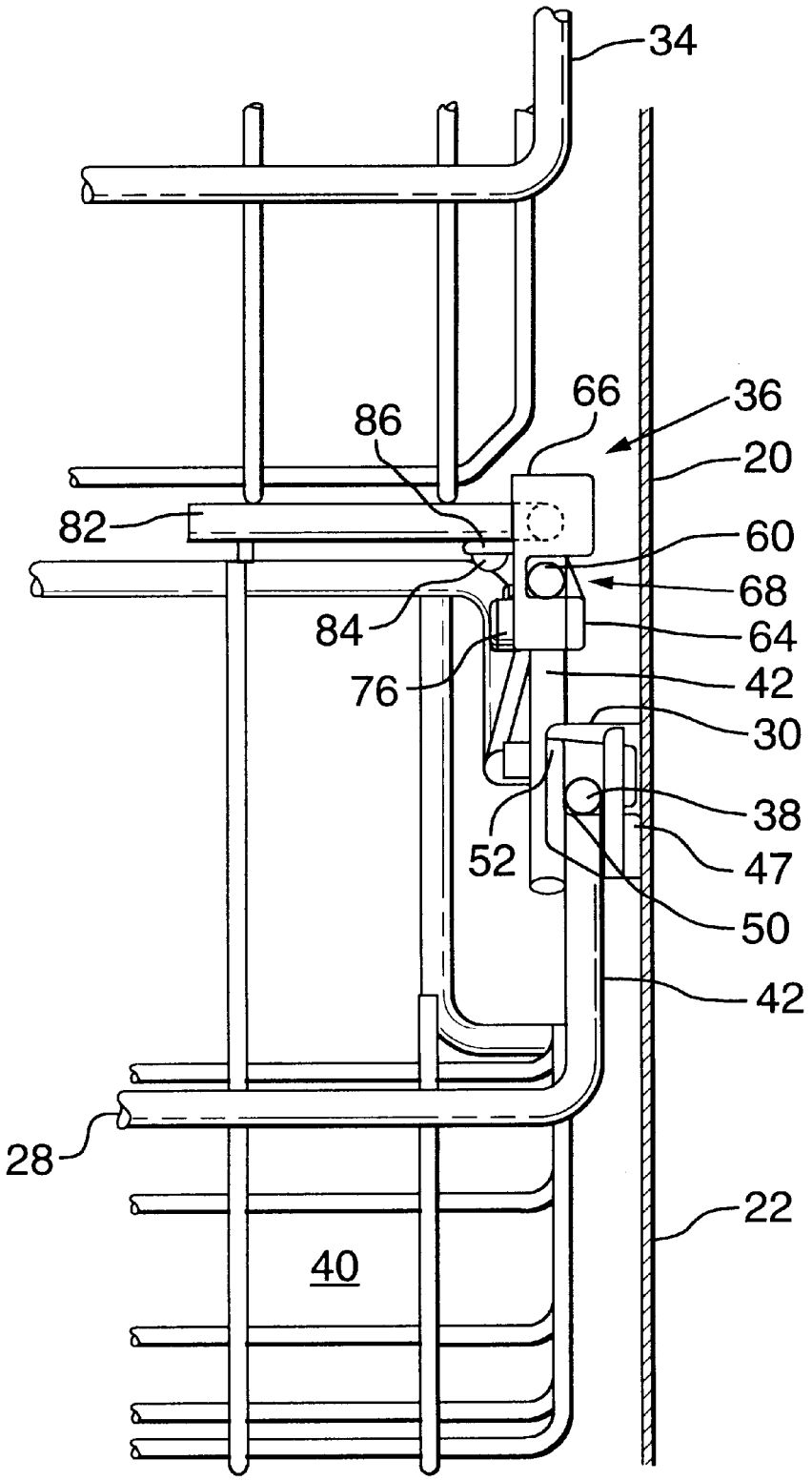
FIG. 4 is an enlarged partial view showing the mounting arrangements used for the lower basket and the upper basket.
Figure 5:
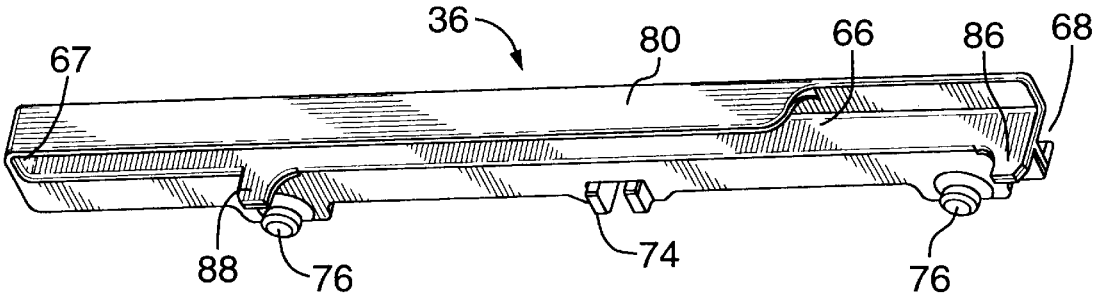
FIGS. 5 and 6 are isometric views of the trackway used between the lower and upper baskets.
Figure 6:
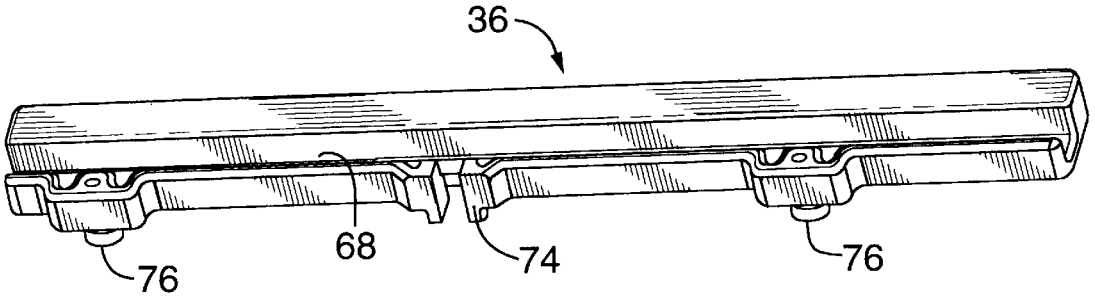
Figure 7:
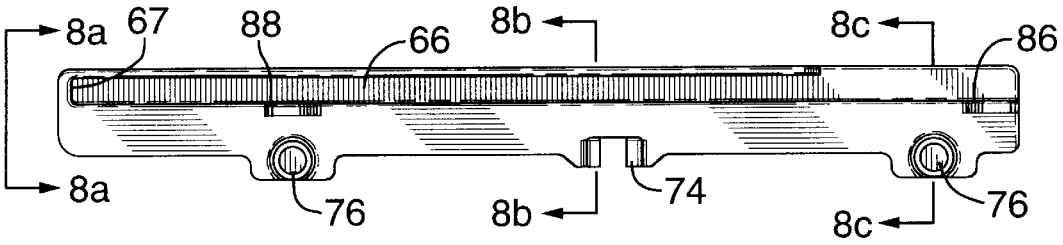
FIG. 7 is an elevational front view of the trackway of FIG. 5.
Figure 8A:
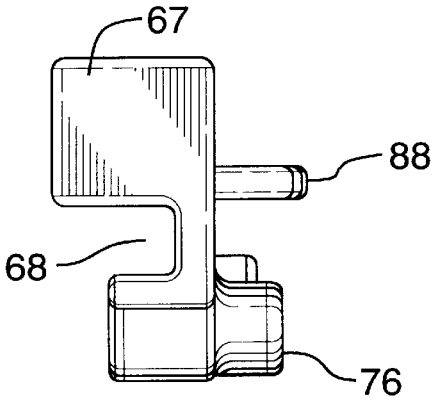
FIGS. 8*a,* 8*b,* and 8*c* are side views of the trackway of FIG. 7 taken at lines 8*a*—8*a,* 8*b*—8*b,* and 8*c*—8*c* of FIG. 7, respectively.
Figure 8B:
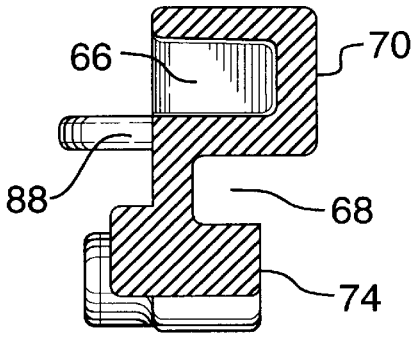
Figure 8C:
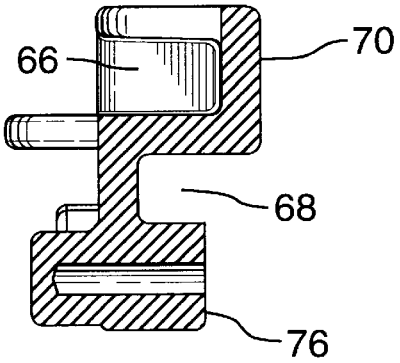
Figure 9:
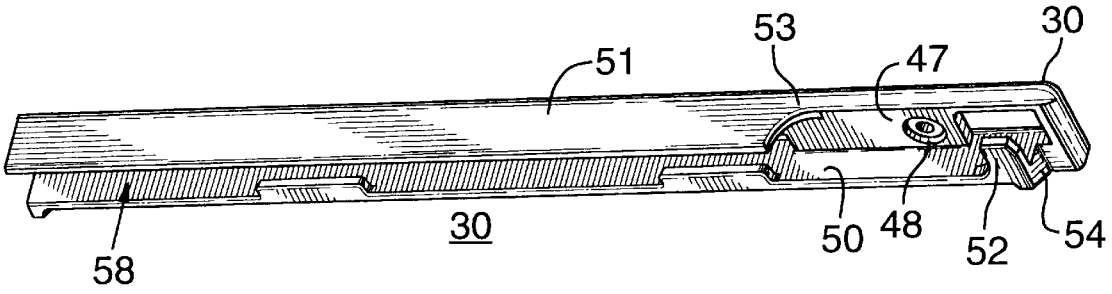
FIG. 9 is an isometric view of the trackway for the lower basket.

Mounted in the freezer compartment 14 is a basket mounting arrangement 27 which also shown in FIG. 2. The basket mounting arrangement 27 includes a first lower basket 28 extending between the side walls 20 and mounted in sliding engagement relative to the side walls 20 by basket support wall rails or first support rails 30. The lower basket 28 includes an ice bucket or tray 32 seated within the basket 28 in the embodiment of FIG. 2 and above the lower basket 28 in the embodiment of FIG. 1. The lower basket 28 further carries a second upper basket 34 mounted for sliding movement relative to the lower basket 28 by upper basket rail supports or second support rails 36. The baskets 28 and 34 are shown to be of a wire construction with a floor and four upstanding side walls. It should be understood that solid baskets constructed from molds of plastic would also be suitable.

The mounting of the lower basket 28 to the side walls 20 of the freezer compartment 14 is described with reference to FIGS. 2, 3, 4 and 9. The lower basket 28 has two side support arms 38 which generally extend horizontally from the front of the freezer compartment 14 to the rear of the freezer compartment. The support arms 38 extend adjacent to the side walls 20. The support arms 38 are connected to the main portion 40 of the lower basket 28 through upstanding rail supports 42 which slope rearwardly toward the rear surface of the freezer compartment 14. The upstanding rails 42 slope in this manner to accommodate for a curved surface in the floor of freezer compartment and also to allow more ready access to food articles contained in the main portion 40 of the basket 28 without having the upper basket 34 restrict access to this main portion 40. The side support arms 38 include a first stop 44 limiting forward movement of the lower basket 28 out of the freezer compartment 14, and a second stop 46 preventing rearward movement of the lower basket 28 into the freezer compartment 14.

Each of the side support arms 38 cooperates with one of the first support rails 30. The first support rail 30 includes a flat elongate wall 47 mounted flush against the side wall 20. The flat elongate wall 47 includes recessed apertures 48 into and through which screws pass to fasten the first support rail 30 to the side wall 20. It should be understood that localized reinforcement may be required on the inside surface of wall 20 to support the weight carried by the lower support rails 30. Each lower support rail 30 has a trackway receiving groove 58 with a floor wall 50 that extends horizontally and perpendicular from the elongate side flat wall 47. The support rail 30 further includes a top wall 51 that extends horizontally along the rail 30 and stops short of the front of the rail 30 at 53. At the front of the rail 30 is a front upstanding wall 52 which extends upwardly from the floor wall 50. The floor wall 50, side wall 47 and top wall 51 define a U-shaped first receiving groove 58 extending horizontally along the side walls 20.

The side arms 38 of the lower basket 28 are adapted to slide within the U-shaped groove 58 on the floor wall 50. Forward sliding movement of the basket 28 out of the open front 22 of the freezer compartment 14 is limited by the stop 44 engaging front upstanding wall 52. Rearward sliding movement of the basket 28 relative to the side walls 20 on the rails 30 is limited by stop 46 of arm 38 engaging the front edge 54 of rails 30.

In accordance with the present invention, in order to allow for the mounting of the upper basket 34 onto the lower basket 28, the lower basket 28 includes a pair of horizontally extending upper support arms 60. The upper support arms 60 are shown spaced vertically above the first support arms 38 and more rearwardly of the main portion 40 of basket 28 than the middle support arms 38. Each of the upper support arms 60 has one stem 62 extending perpendicular to the elongate extension of support arm 60. The elongate rail or support arm 60 includes two downwardly depending flat tabs 64. The flat tab surfaces 64 include apertures 66 into which screws may be threadably fastened. The rail 60 together with stem 62 and tabs 66 cooperate to secure in fixed relation the second support rails 36 to the rail 60.

Each of the second support rails 36 (FIGS. 4 to 8) has a second trackway receiving groove 66 extending horizontally above and along the upper support arms 60. Each of the second support rails 36 has a channel 68 extending horizontally along and partially surrounding the upper support arms 60. Both of the channel 68 and the upper trackway receiving grooves 66 are generally U-shaped in cross-section and open in opposite directions. The top wall 70 of the channel 68 is also the bottom wall 70 of the trackway receiving groove 66.

Channel 68 has a lower wall 72 that includes a notch or slotted aperture 74 extending parallel to the stem 62. When the stem 64 is inserted into notch 74, the upper basket support rail 36 is located in fixed relation to the upper support arm 60. As a result the upper basket support rail 36 is prevented from moving forward and rearward relative to the upper support arms 60 of basket 28.

Channel 68 further includes two spaced apart flat surface bosses 76 which are adapted to receive a threaded fastener. The flat surface of bosses 76 lie flush with the flat tabs 64 of the upper support arm 60. With the threaded fastener passing through apertures 66 in tab 64 and into apertures in bosses 76, the upper basket support rails 36 are prevented from twisting about the support rail arm 60.

The upper basket support rail 36 further includes a top wall 80 having a length less than the over all length of the basket rail support 36. The top wall 80 assists in holding the guide rail or support arms 82 of the upper basket in the trackway receiving groove 66. The receiving groove 66 is closed at the front of the groove by front wall 67.

The upper basket 28 extends between the upper support arms 60 of the lower basket 28. The upper basket 28 includes spaced apart lower arms or supporting arms 82 which are adapted to run or ride forward and rearwardly in the second trackway receiving groove 66 of the upper rail support arm 60.

Figure 10:
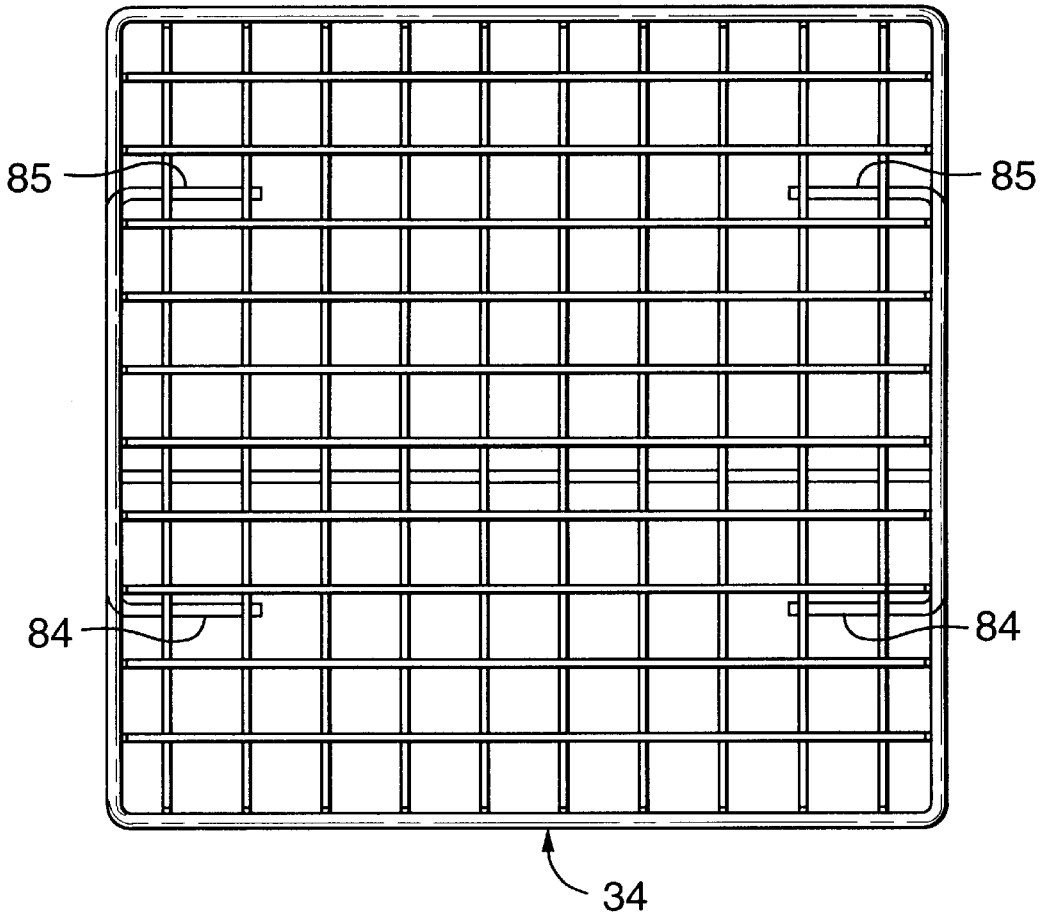
FIG. 10 is a plan view of the upper basket.
Figure 11:
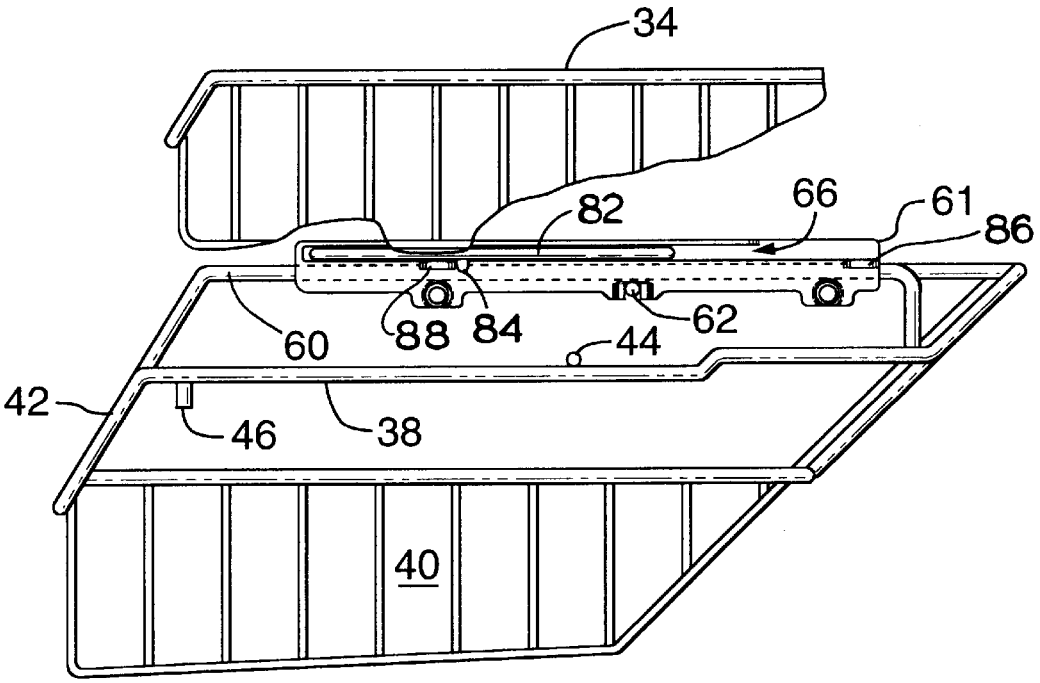
FIGS. 11 and 12 are side views showing the relative forward and rearward positioning of the upper basket relative to the lower basket.
Figure 12:
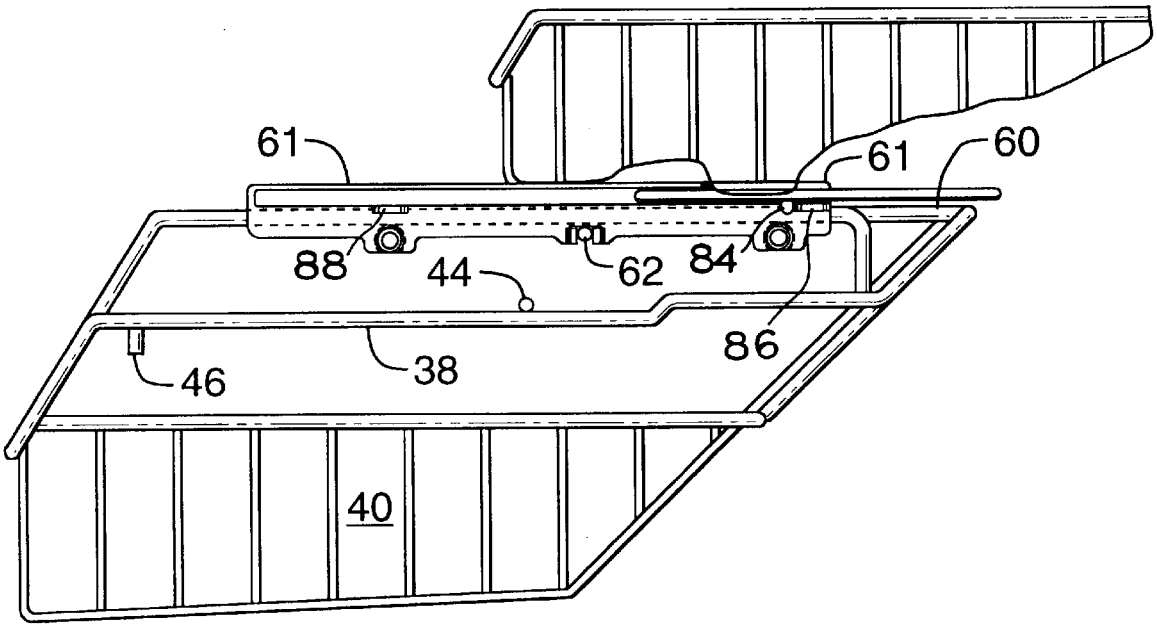

Located below the lower supporting arm 82 as shown in FIG. 10 are forward and rearward stops 84, 85, respectively. Stop 84 engages in its forward most travel abutment edge 88 of the upper basket support rail 36. The upper basket support rail 36 includes a travel abutment edge 86 at the rear portion of the rail 60 to prevent travel of basket 34 rearwardly of the lower basket 28.

The present invention provides for the relative movement of the upper basket 34 with respect to the lower basket 28. The upper basket 34 extends laterally only partially across the cavity 16 of the freezer compartment 14. In practice, a user may bend over and grab the upper basket 34 and pull the upper basket 34 forward through the open front 22 of the refrigerator 10. Should the users desire to access food articles in the lower basket 28, the user can pull the lower basket 28 from the cavity 16 of freezer compartment 14 by sliding the basket forward relative to the lower basket support wall rails 30. Alternatively, the user does not have to bend over as far and may simply pull the upper basket 34 forward causing the upper basket 34 to pull the lower basket 28 out of the opening 22 by acting on the upper support rail arm 60. After the two baskets 28, 34 are pulled forward of the opening, the upper basket 28 can be pushed back into the freezer compartment 14 leaving access to food articles found in the lower basket 28.

Certain preferred embodiments of the invention have been described in detail. From a reading of this disclosure, obvious modifications will be evident to those skilled in the art without departing from the spirit of the invention disclosed or from the scope of the appended claims.

What we claim is:

1. A dual basket mounting arrangement in combination with a domestic refrigerator having a cavity with a rear wall, side walls and an open front, and the dual basket mounting arrangement comprising a first lower basket mounted in the refrigerator between the side walls for sliding movement through the open front of the refrigerator, the first lower basket having spaced apart horizontally extending upper support arms;

a pair of upper basket support rails fixedly mounted to respective ones of the upper support arms of said first lower basket, each of the upper basket support rails providing a second trackway receiving groove extending horizontally above and along the upper support arms, and the upper supporting arms of the first lower basket being positioned rearwardly in the horizontal direction than the remainder of the first lower basket a second upper basket laterally extending between the upper support arms of the first lower basket and having spaced apart horizontally extending lower support arms adapted to slidably engage a respective second trackway of the upper basket support rails to mount the second upper basket relative to the first lower basket for sliding horizontally movement forward and backward above and relative to the first lower basket, and the second upper basket having a horizontal surface area less than the first lower basket.

2. The basket mounting arrangement as claimed in claim 1 wherein each of the horizontally extending upper support arms of the first lower basket comprise an elongate rail having at least one stem extending perpendicular to the elongate rail, and each of the upper basket support rails including a channel portion positioned below the second trackway thereof partially surrounding a respective one of the upper support arms, the channel having a lower wall with a notch extending parallel to the stem for receiving the stem to fixedly locate the upper basket support rail and prevent forward and rearward movement thereof relative to the upper support arms of the first lower basket.

3. The basket mounting arrangement as claimed in claim 2 wherein the elongate rail has at least one depending flat tab surface with a fastener receiving aperture, and the lower wall of the channel further includes at least one dependent flat surface boss with a fastener receiving aperture, the flat boss surface engaging in flush relation the flat tab surface and a fastener securing the flat boss with the flat tab whereby the upper basket support rail is prevented from twisting about the corresponding upper support arm of the first lower basket.

4. The basket mounting arrangement of claim 1 wherein the second upper basket has a width less than that of the first lower basket so that the second upper basket extends partially across the width of the first lower basket.

5. The basket mounting arrangement of claim 1 wherein the refrigerator has an upper fresh food compartment and a lower freezer compartment, and the basket mounting arrangement is mounted in the freezer compartment.

6. A basket mounting arrangement in combination with a domestic refrigerator having a cavity with a rear wall, side walls and an open front, the mounting arrangement comprising:

a pair of basket support wall rails mounted to the side walls of the refrigerator, each of the basket support wall rails providing a first trackway receiving groove extending horizontally along the side walls;

a first lower basket extending between the side walls and having spaced apart horizontally extending side support arms adapted to slidably engage a respective first trackway of the basket support wall rails to mount the first lower basket in the refrigerator for sliding horizontally movement out through the open front, the first lower basket including spaced apart horizontally extending upper support arms, and the upper supporting arms of the first lower basket being positioned rearwardly in the horizontal direction than the remainder of the first lower basket;

a pair of upper basket support rails fixedly mounted to respective ones of the upper support arms of said first lower basket, each of the upper basket support rails providing a second trackway receiving groove extending horizontally above and along the upper support arms; and, a second upper basket extending between the upper support arms of the first lower basket and having spaced apart horizontally extending lower support arms adapted to slidably engage a respective second trackway of the upper basket support rails to mount the second upper basket relative to the first lower basket for sliding horizontally movement forward and backward above and relative to the first lower basket, and the second upper basket having a horizontal surface area less than the first lower basket.

7. The basket mounting arrangement as claimed in claim 6 wherein each of the horizontally extending upper support arms of the first lower basket comprise an elongate rail having at least one stem extending perpendicular to the elongate rail, and each of the upper basket support rails including a channel portion positioned below the second trackway thereof partially surrounding a respective one of the upper support arms, the channel having a lower wall with a notch extending parallel to the stem for receiving the stem to fixedly locate the upper basket support rail and prevent forward and rearward movement relative to the upper support arms of the first lower basket.

8. The basket mounting arrangement as claimed in claim 7 wherein the elongate rail has at least one depending flat tab surface with a fastener receiving aperture, and the lower wall of the channel further includes at least one dependent one flat surface boss with a fastener receiving aperture, the flat boss surface engaging in flush relation the flat tab surface and a fastener securing the flat boss with the flat tab whereby the upper basket support rail is prevented from twisting about the corresponding upper support arm of the first lower basket.

9. The basket mounting arrangement of claim 6 wherein the second upper basket has a width less than that of the first lower basket so that the second upper basket extends partially across the width of the first lower basket.

10. The basket mounting arrangement of claim 6 wherein the refrigerator has an upper fresh food compartment and a lower freezer compartment, and the basket mounting arrangement is mounted in the freezer compartment.

11. A dual basket mounting arrangement in combination with a domestic refrigerator having a cavity with a rear wall, side walls and an open front, and the dual basket mounting arrangement comprising a first lower basket mounted in the refrigerator between the side walls for sliding movement through the open front of the refrigerator, the first lower basket having spaced apart horizontally extending upper support arms;

a pair of upper basket support rails fixedly mounted to respective ones of the upper support arms of said first lower basket, each of the upper basket support rails providing a second trackway receiving groove extending horizontally above and along the upper support arms, each of the horizontally extending upper support arms of the first lower basket comprising an elongate rail having at least one depending flat tab surface with a fastener receiving aperture, and each of the upper basket support rails including a channel portion positioned below the second trackway thereof partially surrounding a respective one of the upper support arms, the channel having a lower wall from which depends at least one flat surface boss with a fastener receiving aperture, the flat boss surface engaging in flush relation the flat tab surface and a fastener securing the flat boss with the flat tab whereby the upper basket support rail is prevented from twisting about the corresponding upper support arm of the first lower basket; and, a second upper basket laterally extending between the upper support arms of the first lower basket and having spaced apart horizontally extending lower support arms adapted to slidably engage a respective second trackway of the upper basket support rails to mount the second upper basket relative to the first lower basket for sliding horizontally movement forward and backward above and relative to the first lower basket.

12. The basket mounting arrangement as claimed in claim 11 wherein the elongate rail has at least one stem extending perpendicular to the elongate rail, and the lower wall of the channel has a notch extending parallel to the stem for receiving the stem to fixedly locate the upper basket support rail and prevent forward and rearward movement thereof relative to the upper support arms of the first lower basket.

13. The basket mounting arrangement of claim 11 wherein the refrigerator has an upper fresh food compartment and a lower freezer compartment, and the basket mounting arrangement is mounted in the freezer compartment.

14. A basket mounting arrangement in combination with a domestic refrigerator having a cavity with a rear wall, side walls and an open front, the mounting arrangement comprising:

a pair of basket support wall rails mounted to the side walls of the refrigerator, each of the basket support wall rails providing a first trackway receiving groove extending horizontally along the side walls;

a first lower basket extending between the side walls and having spaced apart horizontally extending side support arms adapted to slidably engage a respective first trackway of the basket support wall rails to mount the first lower basket in the refrigerator for sliding horizontally movement out through the open front, the first lower basket including spaced apart horizontally extending upper support arms;

a pair of upper basket support rails fixedly mounted to respective ones of the upper support arms of said first lower basket, each of the upper basket support rails providing a second trackway receiving groove extending horizontally above and along the upper support arms, and each of the horizontally extending upper support arms of the first lower basket comprising an elongate rail having at least one depending flat tab surface with a fastener receiving aperture, and each of the upper basket support rails including a channel portion positioned below the second trackway thereof partially surrounding a respective one of the upper support arms, the channel having a lower wall from which depends at least one flat surface boss with a fastener receiving aperture, the flat boss surface engaging in flush relation the flat tab surface and a fastener securing the flat boss with the flat tab whereby the upper basket support rail is prevented from twisting about the corresponding upper support arm of the first lower basket; and, a second upper basket extending between the upper support arms of the first lower basket and having spaced apart horizontally extending lower support arms adapted to slidably engage a respective second trackway of the upper basket support rails to mount the second upper basket relative to the first lower basket for sliding horizontally movement forward and backward above and relative to the first lower basket.

15. The basket mounting arrangement as claimed in claim 14 wherein the elongate rail has at least one stem extending perpendicular to the elongate rail, and the lower wall of the channel has a notch extending parallel to the stem for receiving the stem to fixedly locate the upper basket support rail and prevent forward and rearward movement thereof relative to the upper support arms of the first lower basket.

16. The basket mounting arrangement of claim 14 wherein the refrigerator has an upper fresh food compartment and a lower freezer compartment, and the basket mounting arrangement is mounted in the freezer compartment.

* * * * *